United States Patent [19]

Dix et al.

[11] 4,099,361

[45] Jul. 11, 1978

[54] APPARATUS FOR AND METHOD OF CLOSING CONTAINERS

[75] Inventors: Joseph F. Dix; Joseph Sampson, both of Baltimore, Md.

[73] Assignee: Crown Cork & Seal Company, Inc., Philadelphia, Pa.

[21] Appl. No.: 236,385

[22] Filed: Mar. 20, 1972

[51] Int. Cl.[2] ..... B67B 3/02; B67B 3/12; B67B 3/18; B65B 7/28

[52] U.S. Cl. ..... 53/42; 53/201; 53/331; 53/338

[58] Field of Search ..... 53/201, 368, 328, 304, 53/306, 325, 331, 331.5, 334, 341, 42, 43, 38

[56] References Cited

U.S. PATENT DOCUMENTS

| | | | |
|---|---|---|---|
| 2,359,932 | 10/1944 | Newey | 53/201 |
| 2,915,862 | 12/1959 | Stover | 53/302 X |
| 3,537,231 | 11/1970 | Dimond | 53/201 |
| 3,629,989 | 12/1971 | Reinecke | 53/306 X |
| 3,660,963 | 5/1972 | Sullivan | 53/42 |

*Primary Examiner*—Horace M. Culver

*Attorney, Agent, or Firm*—Woodcock, Washburn, Kurtz & Mackiewicz

[57] ABSTRACT

An apparatus for applying closures to filled bottles. A slide cam cooperating with interchangeable roll-on and crimp-on closure applying heads which are mounted in a rotating turret so as to raise and lower the heads with respect to the bottles. Interchangeable slide cam inserts for the slide cam are provided to modify the slide cam depending upon whether roll-on or crimp-on closure applying heads are mounted in the turret.

18 Claims, 16 Drawing Figures

Fig. 1
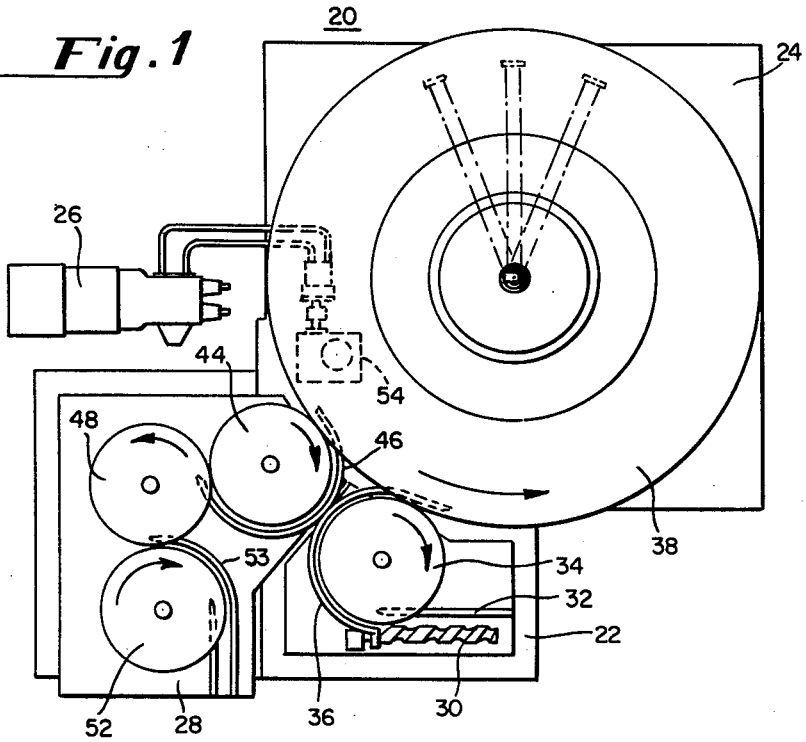
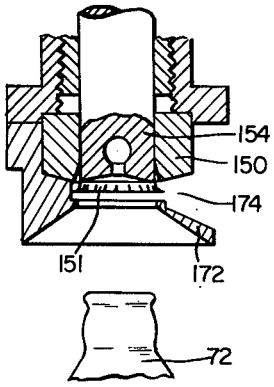
Fig. 10
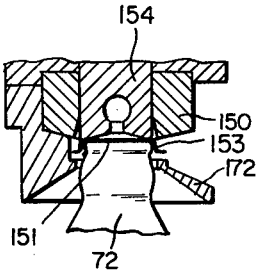
Fig. 11
Fig. 2
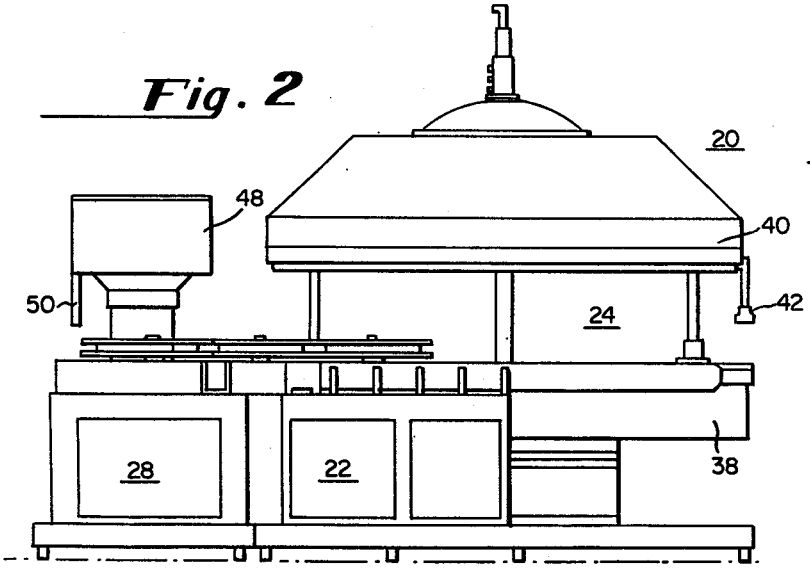
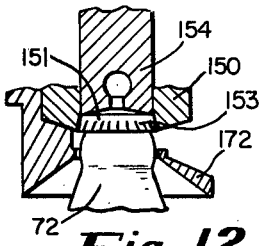
Fig. 12
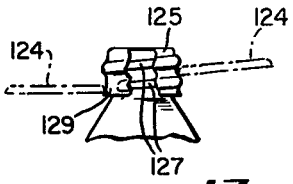
Fig. 13

APPARATUS FOR AND METHOD OF CLOSING CONTAINERS

BACKGROUND OF THE INVENTION

This invention relates to the type of apparatus used by the bottling industry for applying closures to bottles.

In this industry, bottles are filled and closed during a plurality of successive operations which are performed by large, complex and expensive machinery. The apparatus must comprise means for infeeding the bottles to a multi-station filler. The apparatus must also comprise means for transferring the bottles from the filler, means for applying closures of both the roll-on and crimp-on type to the bottles and outfeed means for the closed bottles.

When a crimp-on closure such as a crown is to be applied to a bottle, the closure applying means must be specifically adapted to apply crowns. The entire unit is then manufactured with crown applying heads which cannot be used to apply roll-on caps to bottles. In some instances, roll-on cap type bottles have been filled and closed with machines which have been designed for and include means for filling as well as closing crown type bottles. These machines were used in combination with additional means for applying roll-on caps. In these instances, the expensive crown applying means has been a useless appendage of a rather inflexible piece of equipment. In other instances, entire turrets including heads have been substituted to permit crowns or roll-on caps to be applied. The substitution of turrets is undesirable because of the excessive down time and the necessity for outside rigging help.

The invention set forth in copending application Ser. No. 41,283, filed May 28, 1970, and now U.S. Pat. No. 3,660,963, and assigned to the assignee of this invention, solves the foregoing problems by providing a closure applying turret assembly having interchangeable crimp-on closure applying heads and roll-on closure applying heads. The turret includes slide cam means which cooperate with either the roll-on closure applying heads or crimp-on closure applying heads which are mounted in guide ways at a plurality of revolving head mounts to provide a reciprocating motion of the heads.

Each head which is mounted in the turret is raised and lowered as it moves along the fall, dwell and rise of the slide cam. In both a crimp-on and a roll-on closure applying operation, the head is lowered and in contact with the bottle while the head cooperates with the lower dwell of the slide cam.

Although the same slide cam may be utilized for both a crimp-on and a roll-on closure applying operation, it has now been found that there is some risk of bottle breakage during the crimp-on closure applying operation when the same slide cam is utilized. Since the crimp-on closure applying operation involves the application of substantial force to the closure as it rests on the bottle, a substantial force is transmitted to the bottle, e.g., 750 lbs. When the crimp-on closure applying head is maintained in the lower dwell position for the same length of time that the roll-on closure applying head is maintained in the lower dwell position, the force on the bottle is sustained over a substantial period of time and this sustained force may in some instances be sufficient to break a glass bottle or collapse a plastic bottle.

SUMMARY OF THE INVENTION

It is therefore an object of this invention to provide an apparatus which may be utilized to provide rollon closures as well as crimp-closures without risk of bottle breakage.

In accordance with this object of this invention, a closure applying apparatus is provided comprising a rotating turret including a plurality of mounts for receiving interchangeable roll-on closure applying heads and crimp-on closure applying heads. A slide cam extends along the turret for imparting the vertical motion to the closure applying heads and includes a section receiving interchangeable slide cam sections. When roll-on closure applying heads are mounted on the turret, a slide cam insert is utilized which will maintain the head in the down or lowermost position for an extended period of time. When the crimp-on closure applying heads are mounted on the turret, a slide cam insert is utilized which limits the length of time that the crimp-on closure applying head is in the down or lowermost position. This limited length of time is sufficient to permit the skirt of the closure to be wiped and crimped-on the bottle while avoiding extended periods of stress on the bottle which could result in bottle breakage.

In further accordance with the object of this invention, the slide cam which cooperates with the roll-on closure applying heads includes a fall to and a rise from a lower dwell corresponding to the down dwell of roll-on closure applying heads. The roll-on slide cam insert comprising a section of the lower dwell is removed and replaced by the crimp-on slide cam insert which includes a fall below and a rise to the lower dwell so as to create a down dwell on the crimp-on closure applying heads of substantailly lesser duration than the down dwell of the roll-on closure applying heads.

BRIEF DESCRIPTION OF THE DRAWINGS

FIG. 1 is a plan view of a bottle filling and closing system;

FIG. 2 is an elevational view of the system of FIG. 1;

Figure 7:
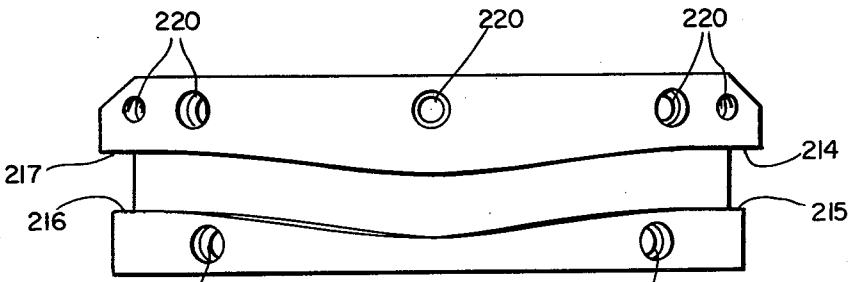

FIG. **6*a*** is a cam track development for the crimp-on slide cam insert;

FIG. **6*b*** is a cam track development for the roll-on slide cam insert;

FIG. 7 is an elevational view of the crimp-on slide cam insert depicted in FIG. **6*a*;**

Figure 8:
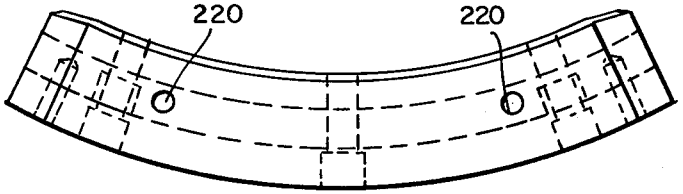

FIG. 8 is a top view of the crimp-on slide cam insert depicted in FIG. **6*a*;**

Figure 3:
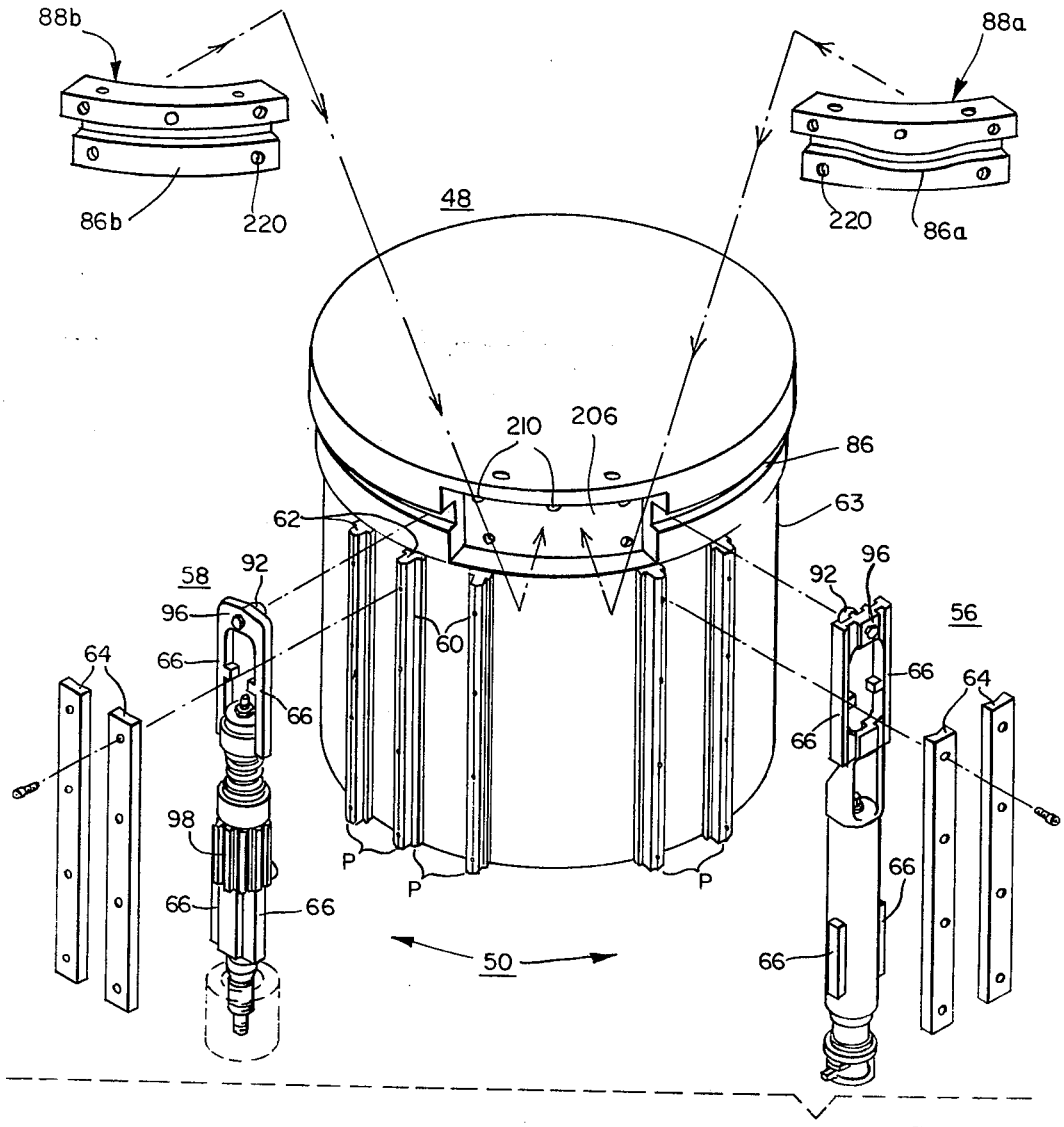
FIG. 3 is an exploded perspective view of a closure turret assembly embodying the invention.
Figure 4:
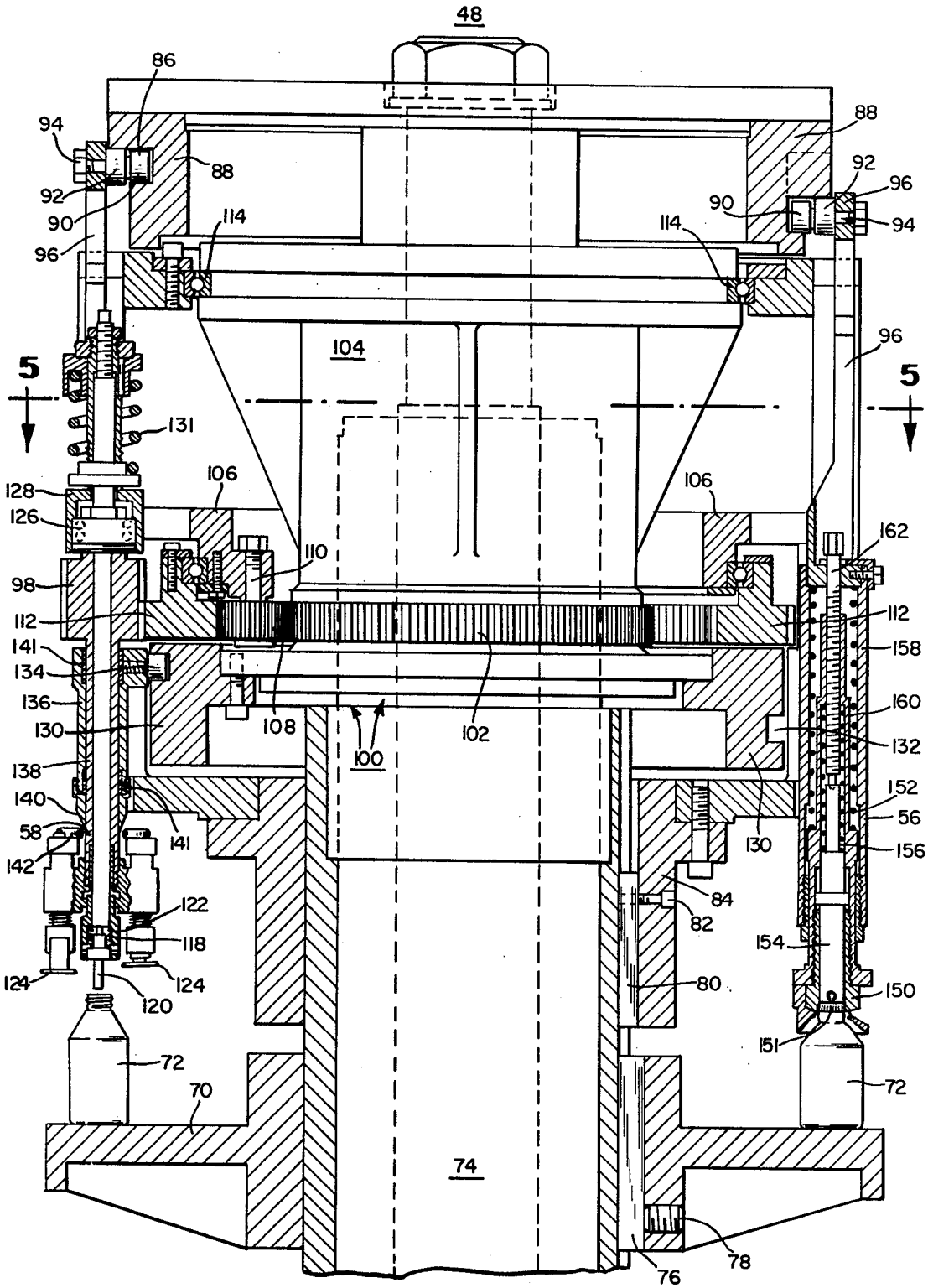
FIG. 4 is a sectional view including the turret assembly of FIG. 3 taken along section line 4—4 of FIG. 5.
Figure 5:
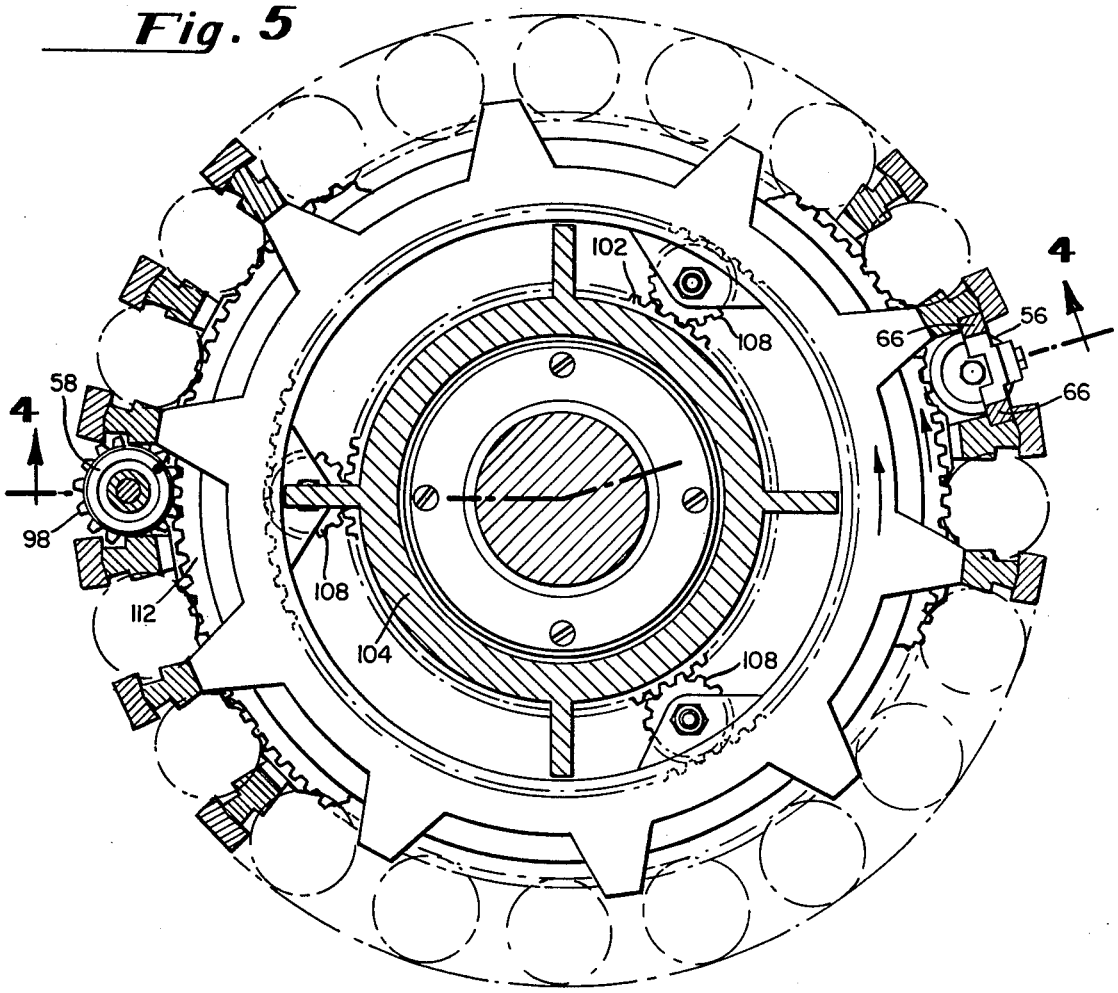
FIG. 5 is a sectional view including the turret assembly of FIG. 3 taken along section line 5—5 of FIG. 4.

FIGS. **9*a* and 9*b*** are schematic diagrams comparing the vertical motion of the crimp-on closure applying head and a roll-on closure applying head with the respective crimp-on slide cam insert and roll-on slide cam insert in place;

FIGS. 10–12 represent various closure applying positions for a crimp-on closure applying head mounted in the turret assembly of FIGS. 3–5; and FIG. 13 represents the application of a roll-on closure to a bottle by a head mounted in the turret assembly of FIGS. 3–5.

DETAILED DESCRIPTION OF THE PREFERRED EMBODIMENT

FIGS. 1 and 2 disclose a filling and closing system 20 comprising an infeed module 22, a filler module 24, a drive module 26, and a closing module 28 including transfer, closure applying, and outfeed means. The apparatus 20 with the particular modular combination shown is designed to fill and close bottles.

The bottles first enter the system at the infeed module 22 through the use of an infeed worm 30 adjacent a back guide 32. The bottles are then carried on an infeed multipocket spider 34 which is rotating in a clockwise direction along a guide 36.

When the bottles enter the filler module 24, they are carried along a counter clockwise path by a cylinder support assembly 38. A valve carrier assembly 40 rotates with the cylinder support assembly 38 to fill the bottles as they move along the counter clockwise path. Only one filling valve tube and bell assembly 42 has been shown, but it will be appreciated that the valve carrier assembly 40 includes a number of these assemblies 42 circumferentially spaced with respect to one another.

When the bottles have been filled, they move to the closing module 28. The bottles are removed from the cylinder support assembly 38 by a multi-pocket transfer spider 44 which is rotating in a clockwise direction to carry the bottles along a guide 46. The bottles then move to the closure applying area of the module 28 with which this invention is concerned.

As shown in FIGS. 1 and 2, the bottles move in a counter-clockwise direction beneath a rotating turret assembly 48 including a plurality of closure applying heads. Only one of the closure applying heads 50 has been shown on the turret 48. A suitable closure feeding mechanism not shown is utilized to supply the closures to the head 50. After the closures have been applied to the bottles, the bottles leave the closing module 28 via an outfeed spider 52 which rotates in a clockwise direction. The spider carries the bottles at a plurality of circumferentially spaced pockets along a guide 53.

In order to drive the apparatus 20, the drive module 26 is provided. As shown, the module 26 comprises a split drive hydraulic power unit which is coupled to an hydraulic motor 54 in the filler module 24. The other modules 22 and 28 are then driven off the motor 54.

The invention as embodied in the turret assembly 48 will now be discussed in somewhat more detail with reference to FIG. 3. In accordance with one very important aspect of the invention, the turret assembly 48 including heads 50 may be adapted to apply crimp-on closures such as steel crowns as well as roll-on closures such as aluminum caps. In order to provide this capability of applying either crowns or roll-on caps, the heads 50 are of two different types, crimp-on closure or crown applying heads 56 or roll-on closure or cap applying heads 58.

As shown, both heads 56 and heads 58 may be interchangeably mounted at any revolving station or mount on the turret 48 with a very simple change-over procedure. Each head receiving mount is provided with a pair of machined rectangular bearing ways 60 in vertically cast ribs 62 which are circumferentially spaced about a substantially conventional turret 63 to provide mounts of a predetermined and constant pitch P. The heads 56 and 58 are then mounted in the bearing ways 60 through the use of a pair of easily removable cover plates 64 which are bolted to the ribs 62. Two sets of machined lugs 66 on each of the heads 56 and 58 are held in guideways formed by the bearing ways 60 and the removable cover plates 64 which are bolted to the ribs 62. These guideways permit the reciprocating or vertical motion which is necessary for applying the crowns and the roll-on caps to the bottles. This vertical motion is imparted by a cam track 86 in a slide cam 88 which is located above the guideways.

In accordance with this invention, the vertical motion which is imparted to the crown applying heads 56 is somewhat different from the vertical motion which is imparted to the cap applying heads. This difference is obtained by the use of different slide cam inserts 88*a* and 88*b* which have somewhat different cam tracks 86*a* and 86*b*.

The insert 88*a* which is utilized during a crimp-on closure or crown applying operation will lower the crown applying heads 56 to the bottles for a brief period of time which is sufficient to permit the skirt of the crown to be crimped or wiped down over the glass finish on the bottle. In contrast, the insert 88*b* maintains the cap applying heads 58 in the down or lowermost position to permit the more time-consuming rolling on of the cap threads.

Thus, by bolting the appropriate insert in place depending upon the type of heads mounted in the turret assembly, the crowns as well as roll-on caps may be applied to bottles. It will therefore be seen that the same turret assembly will provide the cap applying heads 58 with sufficient time in the down or lowermost position of contact with the bottles to permit the rolling-on of threads while limiting the time that crown applying heads 56 are in the down or lowermost position of engagement with the bottles. This limiting engagement between the crown applying heads 56 and the bottles is particularly important so as to avoid sustained stress on the bottles which can result in bottle breakage or collapse.

For purposes of illustration, FIGS. 4 and 5 show the closure applying apparatus including the turret assembly 48 with one crown applying head 56 and one cap applying head 58 in place. It will of course be appreciated that the turret assembly 48 will either carry crowning heads 56 at all of the mounts or capping heads 58 at all of the mounts depending upon the nature of the bottle to be closed.

The closure applying apparatus includes a revolving table 70 which is located beneath the turret assembly 48 for carrying bottles 72 along with the heads 56 or 58 as the turret assembly 48 rotates in a counter clockwise direction. The table 70 is keyed to a drive column 74 at a key 76 and a set screw 78 while the rotating turret 63 is keyed to the drive column 74 at a key 80 and set screw 82 which extends through a turret hub 84. As the column 74 which is coupled to the motor 54 of FIG. 1 rotates thereby rotating the turret 63, the heads 56 and 58 are revolved about the turret axis.

As mentioned previously, reciprocating vertical motion is imparted to the heads 56 and 58 as the cam followers 90 and 92 cooperate with the cam track 86. In accordance with this invention, the motion will depend upon the slide cam insert utilized.

A planetary gear system 100 includes a fixed center gear 102 which is mounted on a center bearing and a gear support member 104 along with a bearing assembly 114. A rotating planetary gear support member 106 which is part of the rotating turret 63 carries a plurality of planetary gears 108 which rotate around shafts 110 and revolve around the gear 102. The planetary gear system 100 further comprises an annular external driving gear 112 which is driven off the planetary gears 108 along the internal surface of the gear 112. The external surface of the gear 112 engages and rotates the capper head spindle driven gear 98.

The operation and configuration of the capper head 58 is substantially conventional. As the cam followers 90 and 92 of the capper head 58 move from the upper dwell position at the left in FIG. 4, through the fall, and to the lower dwell position at the right, the lugs 66 will descend between bearing ways 60 and the cover plates 64 to carry a pressure pad 118 of the head set to the mouth of a bottle 72 having a screw thread glass finish. The cap is held in this position on the mouth of the bottle by a cap control plunger 120 which is biased to an extended position by a spring 122 as shown. On contact with the cap, the plunger 120 retracts within the pressure pad 118. The rotational motion of the head which is achieved by the planetary gear system 100 in combination with the capper head spindle gear 98 then revolves about rollers 124 to both roll the skirt of the cap 125 at bottle threads 127 and roll the lowermost portion of the cap skirt 129 inwardly as shown in FIG. 13.

In order to apply the neccessary sealing pressure to the cap 125 and cap liner as well as accommodate any slight variations in bottle height, a spring 131 is provided. The spring is of sufficient strength to transmit the stroking force provided by the camming track 86 while at the same time providing a stroke take-up function where the length of the stroke exceeds that necessary for the particular bottle which is being capped.

Since only the lower portion of the capper head 58 rotates, bearing means must be provided between the rotating and nonrotating portions. Accordingly, bearing raceways are provided at the upper end of the capper head spindle gear 98 for bearings 126 which are enclosed within a bearing housing 128.

The turret assembly 48 also includes a lower slide cam 130 including a cam track 132 receiving a cam follower 134. The cam follower 134 is part of a lower cam slide 136 of the capper head 58. Only the interior of the capper head 58 and more particularly the pinion spindle 138 is rotating. The lower slide 136 does not rotate with the pinion spindle 138 but is separated therefrom by bushing 141. As the cam follower 134 moves from the upper dwell position at the left, through the fall, and to the lower dwell at the right, the conical camming surface 140 at the lower end of the lower slide 136 engages rollers 142, pivoting the rollers 142 outwardly and the rollers 124 inwardly to engage the cap skirt as shown in FIG. 13. This mechanism is substantially conventional and the details are accordingly well known in the art.

In contrast with the capper head 58 which has a substantially conventional configuration, the crowner head 56 represents a departure from the conventional crowner head configuration. The crowner head 56 includes the lugs 66 which move between bearing ways 60 and the cover plates 62 of the turret 63 to provide the vertical motion derived from a camming track 86 and cam followers 90 and 92. When the head 56 is at the bottom of the vertical stroke, the crowner head 56 is in contact with a threadless bottle 72 after having applied a crown 151. In the position shown, the crowner head throat 150 has wiped and crimped the crown skirt 153 down along the side of the bottle. The throat 150 is held in the position shown by a compensating spring 152 which accommodates slight variations in bottle heights. A presser foot 154 engages the top of the crown with a pressure determined by a presser foot spring 156. The presser foot spring 156 must be sufficiently strong to establish a seal between the bottle mouth and the crown liner.

The compensating spring 152 is located within an annular chamber defined by an outer crowning cylinder 158 at the exterior of the crowner head 56, a compensating slide 160, and the lower end of the crowner slide 96. The presser foot spring 156 is enclosed within a chamber defined by the compensating slide 160 and a crimp adjusting rod 162. If the crimp adjusting rod 162 is backed off or raised with respect to the lower end of the upper slide 96, the crimp on the skirt of the crown is tighter since the skirt will be allowed to reach a deeper point in the throat 150.

It will be noted from FIG. 4 that the camming track 132 and the internal and external gears 112 do not in any way affect or interfere with the crowning operation. The crowner heads are spaced from the gears 112 and therefore are not engaged by or coupled to the gears 112. As mentioned previously, the crowning is achieved by a strictly reciprocating motion without rotational motion and there are no rollers associated with the application of a crown to a bottle as in the case of the roll-on cap.

Figure 6:
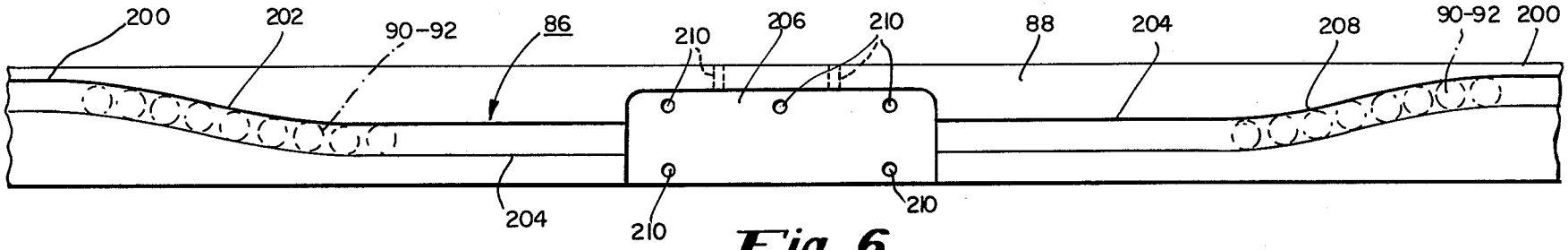
FIG. 6 is a cam track development for the turret assembly slide cam shown in FIG. 3 without the slide cam inserts in place.

The cam track 86 and tracks **86*a* and 86*b* of inserts 88*a* and 88*b* will now be described in substantial detail with reference to FIGS. 6, 6*a* and 6*b*. Referring first to FIG. 6, it will be seen that the cam track 86 comprises an upper dwell 200, a fall 202, a lower dwell 204 which is interrupted by a recessed cavity 206 for receiving the inserts 88*a* and 88*b*, and a rise 208 from the lower dwell back up to the upper dwell 200. The fall 202 is in contact with the cam followers 90 and 92 of the heads 56 and 58 for approximately 50° of rotation of the turret. The followers 90 and 92 are also in contact with the rise 208 for about 50° of turret rotation. The upper dwell 200 and the lower dwell 204 are in contact with the cam followers 90 and 92 for somewhat greater angles of the turret rotation. The upper dwell 200 represents approximately 105° of turret rotation while the lower dwell 204**, exclusive of the cam track provided by the inserts, represents 85° of rotation.

Figure 6A:
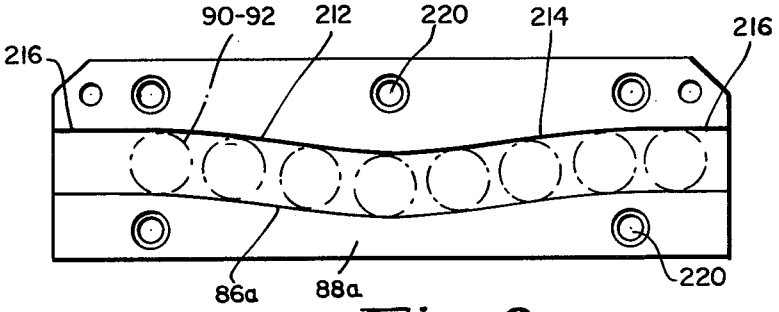
Figure 6B:
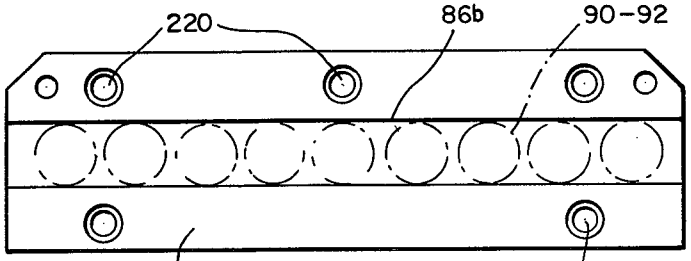

When the crimp-on slide insert **88*a* as depicted by FIG. 6*a* is inserted into the cavity 206, and held by bolts threadedly engaging holes 210, the lower dwell 204 is interrupted by a 20° fall 212 and a 20° rise 214 of the track 86*a* without a dwell therebetween. 5° dwells 216 are provided at each end of the track 86*a*. The total drop below the lower dwells as provided by the fall 212 is only 0.500 inches as compared with the drop of 1.750 inches between the upper dwell 200 and the lower dwell 204. However, this drop is sufficient to permit the crown to be crimped on the bottle finish with a force of 750 lbs or more without applying a sustained force to the bottle while the cam followers move through the lower dwell 204. The cam track 86*b* of the insert 88*b* as shown in FIG. 6*b* does not include a rise and fall. Rather, track 86*b* represents an extension of the lower dwell 204 to allow the heads 58** to remain in the down or lowermost position for a length of time sufficient to allow completion of the roll-on cap applying operation.

The insert 88*a* is shown in somewhat more detail in FIGS. 7 and 8 where its arcuate nature is clearly illustrated. Note that the upper cam surface 217 projects out over the lower cam surface 218 and engages both cam followers 90 and 92. Note also the holes 220 which extend through the face and the top of the insert 88*a* and are in alignment with the holes 210 in the slide cam cavity 206.

Figure 9A:
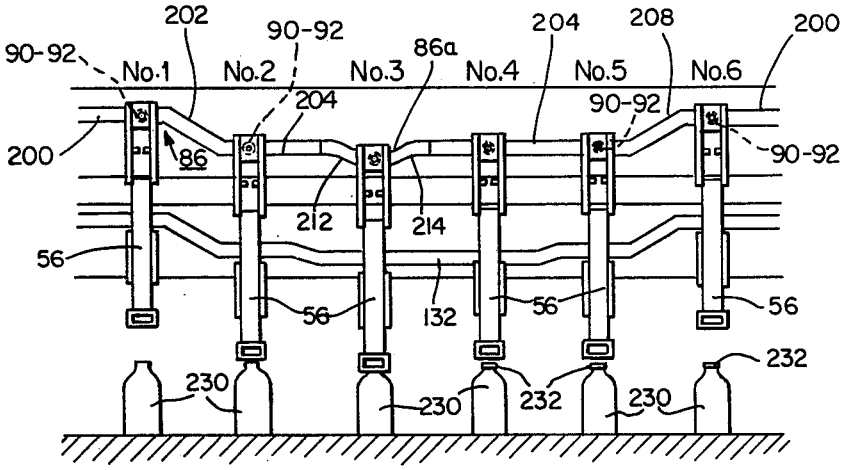
Figure 9B:
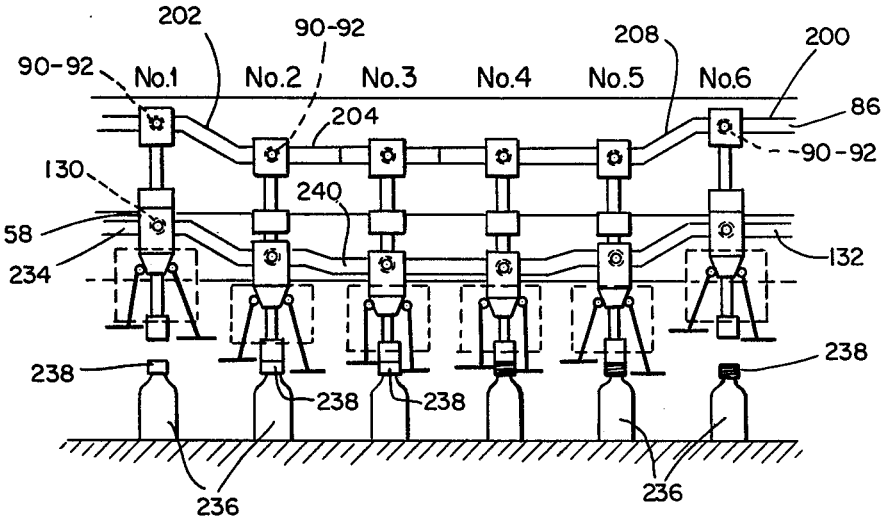

Reference will now be made to FIGS. 9*a* and 9*b* for a comparison of the vertical motion for the heads 56 and 58 with the different inserts 88*a* and 88*b* in place in the slide cam 88. FIG. 9*a* shows both the upper slide cam track 86 and the lower slide cam track 132 with a plurality of crown applying heads 56 in various positions along these cam tracks. It will of course be understood that the heads 56 do not engage or are not in any way coupled to the lower cam track 132. In position no. 1, cam followers 90 and 92 are engaging the upper dwell 200 of the cam track 86 with the lower portion of the head 56 spaced well above the bottle 230. In position no. 2, the cam followers 90 and 92 have passed through the fall 202 and into the lower dwell 204. Although the figure is somewhat exaggerated, the lower end of the heads 56 in position no. 2 is still spaced above the bottle 230. In position no. 3, the cam followers 90 and 92 are between the fall 212 and the rise 214 of the insert track 86*a*. In this position, the lower end of the head 56 is down on the bottle so as to apply a considerable force to the bottle during the application of a crown 232. However, this force is only momentary since the cam followers 90 and 92 travel back up the rise 214 to the lower dwell 204 characterized by positions no. 4 and no. 5. Note that the lower ends of the heads 56 are spaced above the bottles 220. In position no. 6, the cam followers 90 and 92 have just traveled up the rise 208 back to the upper dwell 200.

The position of the head 56 with respect to the crown 151 will not be examined in detail with reference to FIGS. 10–12.

In FIG. 10, representing position no. 2 of FIG. 9*a* the crown 151 is shown at the opening of the throat 150 after entering a crown platform 172 through an opening 174. The crown 151 is held in place by magnetic means in the presser foot 154.

As shown in FIG. 11, representing an intermediate position between positions nos. 2 and 3 of FIG. 9*a*, the throat 150 and the presser foot 154 have descended toward the mouth of the bottle with the presser foot 154 resting on the top of the crown 151. At this point in time, the preload compression on the presser foot spring 156 is increased due to the continuing downward movement of the compensating slide 158. The compensating spring 152 remains under preload compression only.

In FIG. 12, representing position no. 3 of FIG. 9 the throat 150 has wiped and crimped the crown skirt 153 on the threadless bottle 72. The compensating spring is now additionally compressed and in a position corresponding to the position shown in FIG. 4 where the cam followers 90 and 92 of the crowner head 56 are in the lower dwell of the cam track 86. As the cam followers 90 and 92 ride up the cam track 214 to position no. 4 of FIG. 9*a*, the compensating spring 52 will first be released to a state of preload compression followed by the release of the presser foot spring 156 back to preload compression which serves to eject the crown from the throat 150.

With cap applying heads 58 mounted in the turret and the insert 88*b* in place, the vertical motion of the cap applying heads is somewhat different. In position no. 1, the cam followers 90 and 92 are in contact with the upper dwell 200 while the cam follower 130 is in contact with an upper dwell 234 of the lower cam track 132. In position no. 2, the cam followers 90 and 92 have descended the fall 202 to the lower dwell 204. With the insert 88*b* in place, the lower dwell will continue through position nos. 3–5. Throughout these positions, the lower end of the head 56 remains down on the bottles 236. As the cam follower 134 moves through the cam track 132 in position nos. 2–5, the rollers 124 are brought into engagement with the caps 238. Because this is a rather time consuming operation, an extended lower dwell is required to maintain the heads 58 in the down or lowermost position while the cam follower 134 is in the lowermost dwell 240. When the operation is completed, the cam followers 90 and 92 travel through the rise 208 back up to the upper dwell 200 at position no. 6. It wil be understood that there is no risk of bottle breakage when the heads are held in the down or lowermost position for an extended period of time since the heads 56, unlike the heads 58, do not apply the large downward force against the bottle to perform the capping operation.

It will of course be appreciated that it is a relatively simple matter to change the machine over for use for different types of heads. Assuming that cap applying heads 58 are presently mounted on the machine, these heads are first removed from their respective mounts by removal of the plates 64, best shown in FIG. 3. The cam slide insert 88*b* is removed and then replaced with the cam slide insert 86*a*. The crown applying heads 56 may then be mounted in the turret with the plates 64 replaced and the crown applying operation is ready to begin with the rotation of the turret.

While a particular embodiment of the invention has been described, it will be understood that various modifications may be made which fall within the true spirit and scope of the invention as set forth in the claims.

What is claimed is:

1. In an apparatus for applying roll-on closures to containers comprising a rotating turret having a plurality of revolving head mounts with vertical guideways adapted to receive roll-on closure applying heads, an upper slide cam extending along said rotating turret and adapted to cooperate with cam slides of said roll-on closure applying heads at said plurality of mounts for creating vertical reciprocating motion of said heads through said guideways, said upper slide cam being characterized by an upper dwell which cooperates with the cam slides of said roll-on closure applying heads to hold said heads above and out of engagement with the bottles, a lower dwell which cooperates with said cam slides of said roll-on closure applying heads to hold said heads in contact with the bottles for a predetermined period of time, and a rise and fall between said upper dwell and said lower dwell, a lower cam slide adapted to cooperate with cam slides of said roll-on closure applying heads to move the rollers of said heads into and out of engagement with roll-on closures, said lower cam slide holding said rollers in contact with said roll-on closures during a substantial portion of said predetermined length of time, and a driving gear adapted to cooperate with said roll-on closure applying heads to spin the rollers of said heads for threading the roll-on closure, the improvement comprising:

a plurality of crimp-on closure applying heads mounted in said mounts and including slide cam means cooperating with said lower slide cam; and an upper slide cam insert being mounted in place of a removed section of said lower dwell of said upper slide cam, said insert including a fall from said lower dwell and a rise to said lower dwell to create a vertical motion of said crimp-on closure applying heads through said guide ways of said mounts, said crimp-on closure applying heads descending to and applying crimping pressure on the containers during substantially less than said predetermined period of time and only when said cam slide means of said crimp-on closure applying heads are cooperating with said slide cam insert so as to substantially eliminate any risk of container breakage during the application of crimp-on closures.

2. The improved apparatus of claim 1 wherein said slide cam insert includes the fall and the rise without a dwell therebetween.

3. The improved apparatus of claim 1 wherein the fall of said insert is substantially smaller than the fall between the upper dwell and the lower dwell of said lower slide cam means.

4. The improved apparatus of claim 1 wherein said lower dwell of said lower slide cam extends along said rotating turret for an angle more than double the angle which said slide cam insert extends along said turret.

5. The improved apparatus of claim 1 wherein said slide cam insert includes a dwell at each end thereof.

6. An apparatus for applying closures comprising:

a rotating turret having a plurality of revolving mounts for closure applying heads and drive gear means associated with each of said mounts;

an upper slide cam means extending along said turret including a fixed cam having a lower dwell interrupted by a discontinuity and interchangeable roll-on slide cam and crimp-on slide cam inserts for mounting in said discontinuity, said roll-on slide cam insert having a cam surface adapted to be mounted as a continuation of said lower dwell through said discontinuity and said crimp-on slide cam insert having a cam surface adapted to fall from and rise to said lower dwell in said discontinuity;

a lower slide cam means extending along said turret;

roll-on closure applying heads mountable at said head mounts, each of said roll-on closure applying heads comprising closure applying rollers for engaging the roll-on closures, an upper cam slide means cooperating with said fixed cam lower dwell and said roll-on slide cam insert for imprating a reciprocating motion to said roll-on closure applying heads with a down dwell duration representing a predetermined period of time, a lower cam slide means cooperating with said lower slide cam means for moving said rollers into and out of engagement with the roll-on closures and a driven gear means cooperating with said dirve gear means for imparting a revolving motion to said roll-on closure applying rollers; and crimp-on closure applying heads interchangeably mountable at said revolving head mounts in place of said roll-on closure applying heads without being rotated by said drive gear means, said crimp-on closure applying heads comprising upper cam slide means cooperating with said crimp-on slide cam insert in place for imparting a reciprocating head motion to said crimp-on applying heads with a down dwell duration substantially less than said predetermined period of time.

7. The apparatus of claim 6 wherein said upper slide cam is characterized by an upper dwell, a fall, a lower dwell interrupted by said insert, and a rise back to said upper dwell.

8. The apparatus of claim 6 wherein said crimp-on slide cam insert has a fall below said lower dwell and a rise back to said lower dwell.

9. The apparatus of claim 6 further comprising bolts wherein said roll-on slide cam insert and said crimp-on slide cam insert include openings for receiving said bolts permitting said inserts to be interchangeably mounted in said lower dwell of said upper slide cam means.

10. A method of applying crimp-on closures to containers with an apparatus comprising a rotating turret having a plurality of revolving head mounts with vertical guideways adapted to receive roll-on closure applying heads, a slide cam extending along said turret and having a fall to and a rise from a lower dwell adapted to cooperate with cam slides of said roll-on closure applying heads at said plurality of mounts for producing a vertical reciprocating motion through said guideways, the method comprising the steps of:

removing said roll-on closure applying heads from said turret;

removing a section of said slide cam at said lower dwell;

replacing said removed section with another section having a fall from and a rise to said lower dwell;

mounting crimp-on closure applying heads at said mounts on said turret; and rotating said turret so as to impart a vertical motion to said crimp-on closure applying heads with said other section in place resulting in a down dwell of said crimp-on closure applying heads on said containers for a lesser period of time than a down dwell of said roll-on closure applying heads on said containers with the removed cam section in place.

11. A turret assembly for applying crowns to bottles comprising:

a rotating turret member having a plurality of revolving head mounts adapted to receive roll-on cap applying heads;

a slide cam means associated with each of said head mounts adapted to drive roll-on cap applying heads through a vertical stroke including a down dwell on the bottles, said slide cam means comprising a fall to and a rise from a lower dwell corresponding to the down dwell of the roll-on cap applying heads, said lower dwell including a removable section;

a drive gear means associated with each of said head mounts to drive said roll-on cap applying heads in a rotational motion;

a plurality of crown applying heads fully interchangeable with roll-on cap applying heads mounted at said head mounts; and a crown applying slide cam insert interchangeable with said removable section and comprising a fall from and a rise to said lower dwell so as to drive said crown applying heads through a vertical stroke including a down dwell of a substantially shorter duration and the down dwell of the roll-on cap applying heads.

12. The turret assembly of claim 11 wherein said crown applying slide cam insert includes said fall and said rise without a dwell therebetween.

13. The turret assembly of claim 11 wherein the fall of said crown applying slide cam insert is substantially smaller than the fall to and the rise from the lower dwell of said slide cam means.

14. The turret assembly of claim 11 wherein said lower dwell of said slide cam means extends along said rotating turret for an angle more than double the angle which said crown applying slide cam insert extends along said turret.

15. A method of applying crimp-on closures to containers with an apparatus comprising a rotating turret having a plurality of head mounts adapted to receive roll-on closure applying heads, a slide cam extending along said turret and having a fall to and a rise from a lower dwell adapted to drive said roll-on closure applying heads at said plurality of mounts for producing a vertical reciprocating motion, the method comprising the steps of:

removing said roll-on closure applying heads from said turret;

removing a section of said slide cam at said lower dwell;

replacing said removable section with another section having a fall from and a rise to said lower dwell;

mounting crimp-on closure applying heads at said mounts on said turret; and rotating said turret so as to impart a vertical motion to said crimp-on closure applying heads with said other section in place resulting in a down dwell of said crimp-on closure applying heads on said containers for a lesser period of time than the down dwell of said roll-on applying heads on said containers with the removed section in place.

16. In a capping machine which includes a rotatable turret adapted to receive either roll-on spindles or swage-on spindles with capping heads thereon for applying closures to containers and including an annular cam member with a grooved cam track therein for vertically moving such spindles when they are rotated about the axis of the turret, said spindles having cam followers on them for moving in the grooved cam track in said cam member and said cam member including a substantially horizontal leg for holding a roll-on spindle in a lowermost position in engagement with a closure on a container as the closure skirt is deformed against the container finish, the improvement comprising:

swage-on spindles which are adapted to be mounted in said rotatable turret with the capping head on each such spindle out of contact with a closure on a container when the cam follower on such spindle is in said horizontal leg of the grooved cam track in said annular cam member; and a replaceable cam section in said horizontal leg of said cam member and a U-shaped cam track in said section for camming a swage-on spindle with a capping head thereon downward to swage a closure on a container, and thereafter substantially immediately upward to strip the capping head from the closed container.

17. A machine as set forth in claim 16 in which said turret has outwardly open vertical guideways therein for receiving either roll-on or swage-on spindles.

18. A machine as set forth in claim 16 in which said groove in said cam member has an upper and lower surface, one of which projects outward beyond the other, and each of said cam followers comprise two rollers, each of which engages only one of said surfaces.

* * * * *

UNITED STATES PATENT AND TRADEMARK OFFICE

CERTIFICATE OF CORRECTION

PATENT NO. : 4,099,361

DATED : July 11, 1978

INVENTOR(S) : Joseph F. Dix and Joseph Sampson

It is certified that error appears in the above-identified patent and that said Letters Patent are hereby corrected as shown below:

Column 2, line 4, delete "rollon" and insert --roll-on--.

Column 7, line 62, delete "52" and insert --152--.

Signed and Sealed this

Sixth Day of February 1979

[SEAL]

*Attest:*

RUTH C. MASON
*Attesting Officer*

DONALD W. BANNER
*Commissioner of Patents and Trademarks*